US011572891B1

(12) United States Patent
Hsieh et al.

(10) Patent No.: US 11,572,891 B1
(45) Date of Patent: Feb. 7, 2023

(54) CEILING FAN BLADE

(71) Applicant: HOTECK INC., Taichung (TW)

(72) Inventors: Lung-Fa Hsieh, Taichung (TW); Yu-Chen Hsieh, Taichung (TW); Min-Yuan Hsiao, Taichung (TW); Chia-Wei Chang, Taichung (TW); Kai-Jen Tsai, Taichung (TW)

(73) Assignee: HOTECK INC., Taichung (TW)

( * ) Notice: Subject to any disclaimer, the term of this patent is extended or adjusted under 35 U.S.C. 154(b) by 0 days.

(21) Appl. No.: 17/394,410

(22) Filed: Aug. 5, 2021

(51) Int. Cl.
*F04D 29/38* (2006.01)
*F04D 19/00* (2006.01)

(52) U.S. Cl.
CPC ..... *F04D 29/384* (2013.01); *F04D 19/002* (2013.01)

(58) Field of Classification Search
CPC ..... F04D 29/384; F04D 19/002
See application file for complete search history.

(56) References Cited

U.S. PATENT DOCUMENTS 4,974,633 A * 12/1990 Hickey ..... B64C 11/18 416/235
5,540,406 A * 7/1996 Occhipinti ..... B64C 21/10 244/200.1
2004/0187691 A1* 9/2004 Lee ..... F04D 29/388 96/134
2006/0110257 A1* 5/2006 Huang ..... F04D 29/384 416/235

* cited by examiner

*Primary Examiner* — Aaron R Eastman
(74) *Attorney, Agent, or Firm* — Li & Cai Intellectual Property Office

(57) ABSTRACT

A ceiling fan blade is provided. The ceiling fan blade is configured to be mounted on a rotating base, and includes a main body and a blade holder connected to the main body. The blade holder is configured to be mounted on the rotating base. The main body includes a windward part arranged adjacent to a side of the main body and a plurality of air guiding structures arranged adjacent to the windward part. Each of the air guiding structures and the side of the main body that is adjacent to the windward part is 0.2 to 0.4 times of a width of the main body.

6 Claims, 6 Drawing Sheets

CEILING FAN BLADE

FIELD OF THE DISCLOSURE

The present disclosure relates to a fan blade, and more particularly to a ceiling fan blade.

BACKGROUND OF THE DISCLOSURE

Generally, a ceiling fan includes a plurality of ceiling fan blades, and the ceiling fan enables the ceiling fan blades to rotate by a driving force of a motor or blowing of wind. However, a resistance can be created when each of the rotating ceiling fan blades is in continuous contact with the air, regardless of a rotational speed thereof. Accordingly, the rotational speed of each of the rotating ceiling fan blades is reduced due to a large area of friction with the air.

Therefore, how to overcome the above-mentioned deficiency through an improvement in structural design has become one of the important issues to be solved in the related art.

SUMMARY OF THE DISCLOSURE

In response to the above-referenced technical inadequacy, the present disclosure provides a ceiling fan blade to effectively overcome issues associated with conventional ceiling fan blades.

In one aspect, the present disclosure provides a ceiling fan blade that is configured to be mounted on a rotating base, and the ceiling fan blade includes a main body and a blade holder. The main body includes a windward part arranged adjacent to a side of the main body and a plurality of air guiding structures arranged adjacent to the windward part. Each of the air guiding structures and the side of the main body that is adjacent to the windward part have a distance there-between that is 0.2 to 0.4 times of a width of the main body. The blade holder is connected to the main body, and the blade holder is configured to be mounted on the rotating base.

Therefore, by virtue of "the distance defined between each of the air guiding structures and the side of the main body that is adjacent to the windward part being 0.2 to 0.4 times of the width of the main body", the ceiling fan blade of the present disclosure can provide a smoother air flow, and an airflow generated thereby can be increased.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
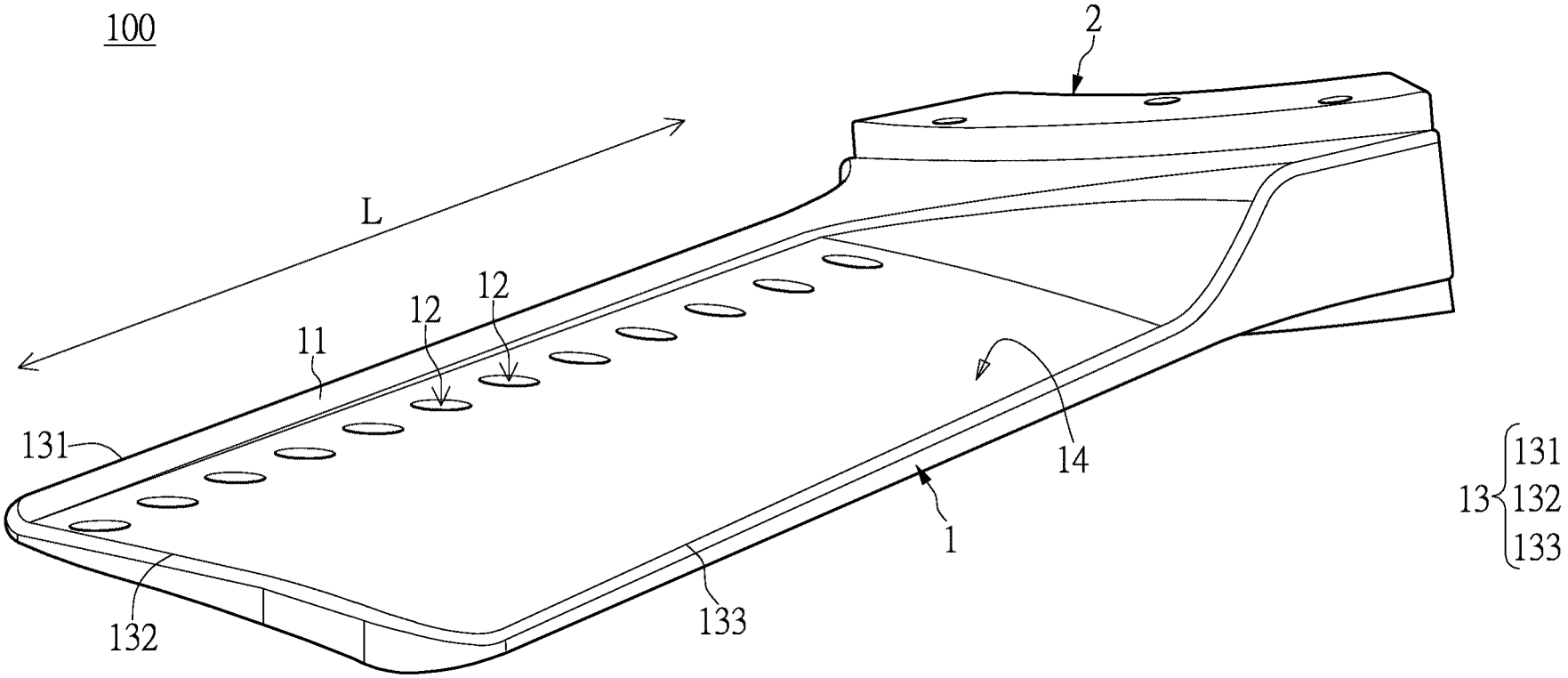
FIG. 1 is a perspective view of a ceiling fan blade according to an embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Figure 2:
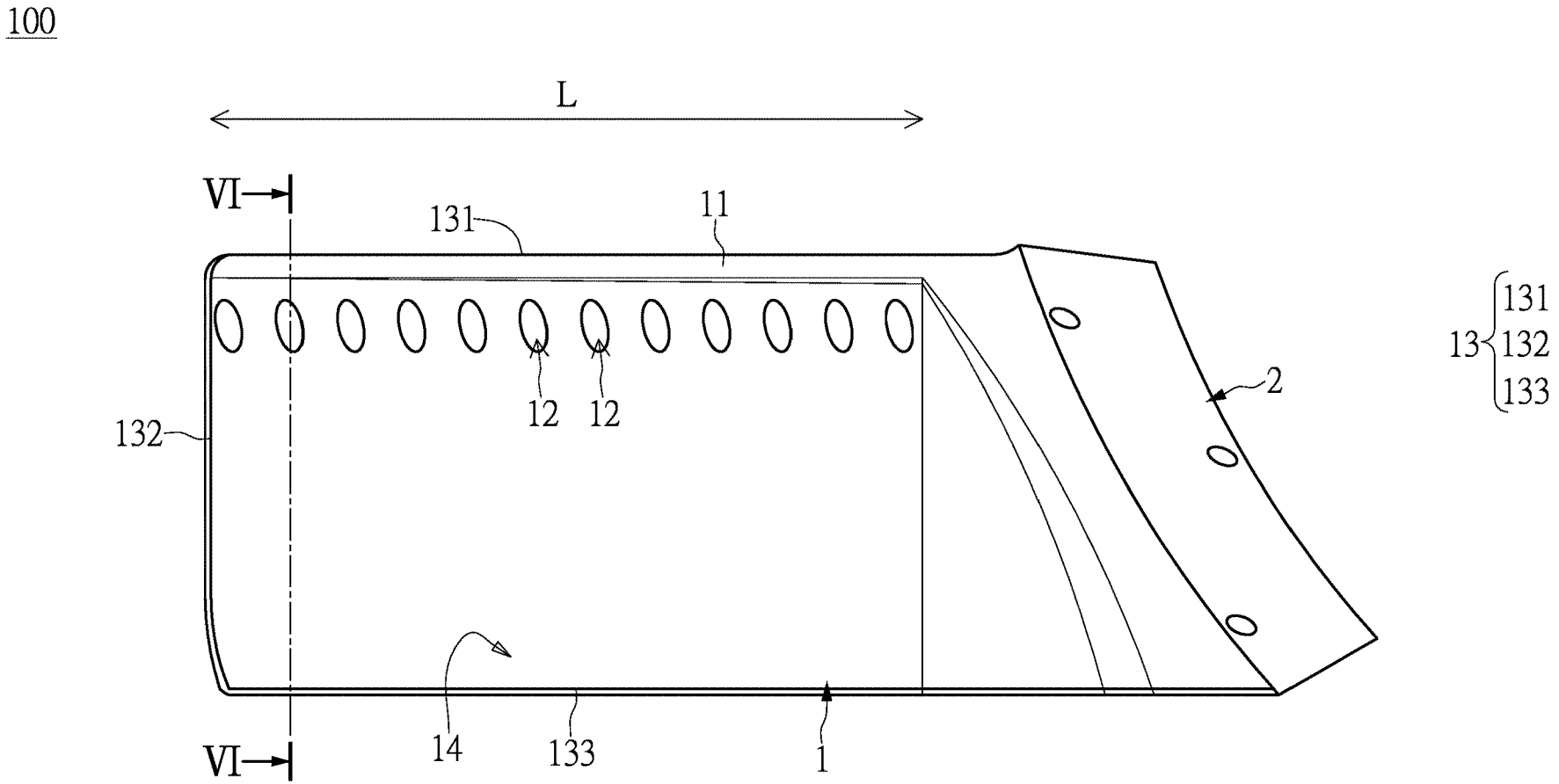
FIG. 2 is a top view of the ceiling fan blade according to the embodiment of the present disclosure.

Referring to FIG. 1 to FIG. 6, an embodiment of the present disclosure provides a ceiling fan blade 100. As shown in FIG. 1 and FIG. 2, the ceiling fan blade 100 is configured to be mounted on a rotating base (not shown in the drawings), and the ceiling fan blade 100 includes a main body 1 and a blade holder 2 connected to the main body 1. The blade holder 2 is configured to be mounted on the rotating base.

It should be noted that the structure of the rotating base and the structure of the blade holder 2 are not the focus of improvement in the present disclosure, and will not be described herein. Here, only features that differ from the related art will be introduced.

The main body 1 includes a windward part 11 and a plurality of air guiding structures 12 arranged adjacent to the windward part 11, and the windward part 11 is arranged adjacent to an outer periphery 13 of the main body 1. Specifically, in the present embodiment, the outer periphery 13 sequentially includes a first side edge 131, a second side edge 132, and a third side edge 133. The first side edge 131, the second side edge 132, and the third side edge 133 each have a length, and the lengths of the first side edge 131 and the third side edge 133 are greater than the length of the second side edge 132.

It should be noted that the second side edge 132 corresponds in position to the blade holder 2. The first side edge 131 and the third side edge 133 are connected to two ends of the blade holder 2, respectively. In addition, the windward part 11 is arranged adjacent to the first side edge 131. The air guiding structures 12 are arranged adjacent to a side of the windward part 11 that is relatively distant from the first side edge 131.

Figure 3:
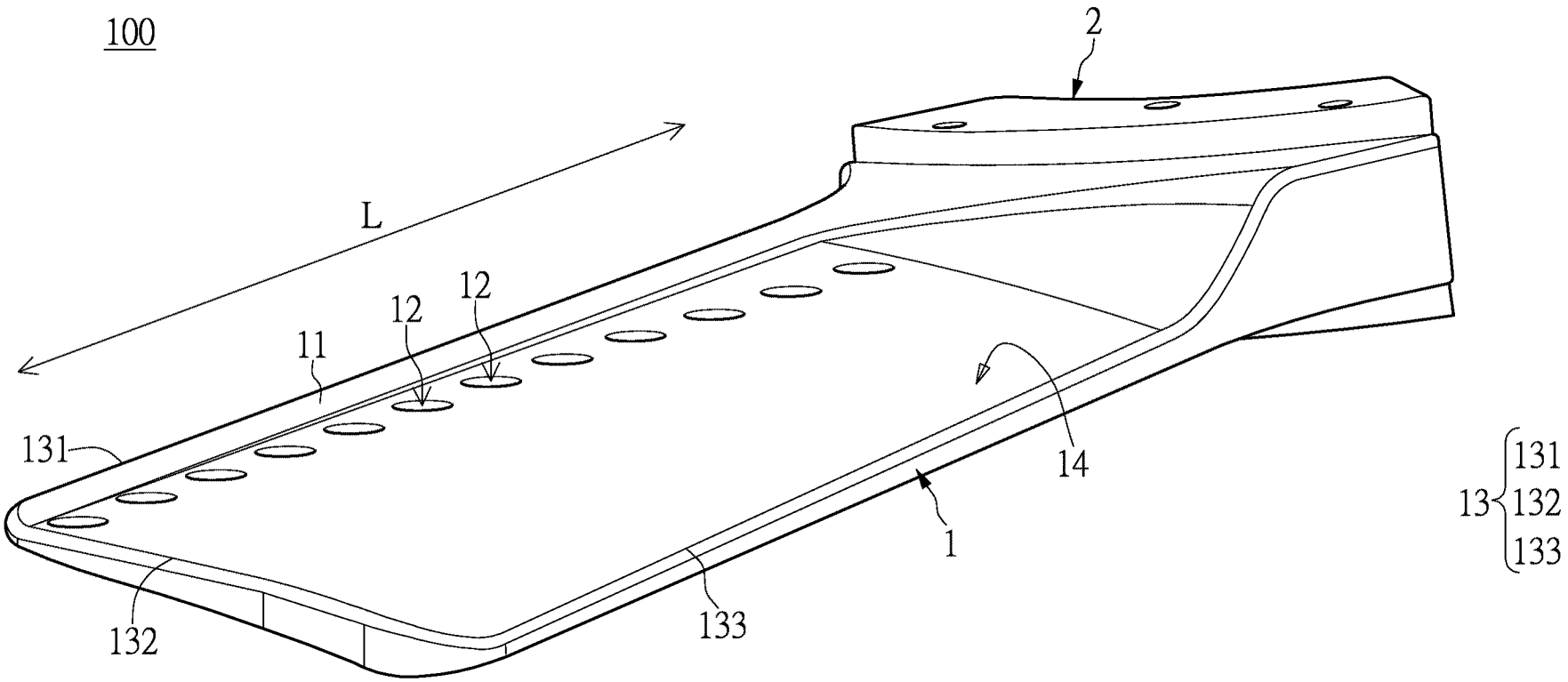
FIG. 3 is another perspective view of the ceiling fan blade according to the embodiment of the present disclosure.

As shown in FIG. 1 and FIG. 2, in the present embodiment, the first side edge 131 is in a linear shape, and the air guiding structures 12 are arranged in a row. The air guiding structures 12 are arranged in a direction parallel to a longitudinal direction L of the first side edge 131 that is adjacent to the windward part 11. However, the present disclosure is not limited thereto. For instance, as shown in FIG. 3, the air guiding structures 12 can be arranged in a direction not parallel to the longitudinal direction L of the first side edge 131 that is adjacent to the windward part 11. In the present embodiment, a quantity of the air guiding structures 12 arranged in a row is 10 to 14. However, the present disclosure is not limited thereto. For instance, in other embodiments of the present disclosure (not shown in the drawings), the quantity of the air guiding structures 12 arranged in a row can also be adjusted according to practical requirements.

As shown in FIG. 2, it should be noted that each of the air guiding structures 12 and the first side edge 131 of the main body 1 that is adjacent to the windward part 11 have a distance there-between that is 0.2 to 0.4 times of a width of the main body 1. Said distance is preferably 0.25 to 0.35 times of the width of the main body 1.

Specifically, when the ceiling fan blades 100 are being rotated, air flows hit the windward part 11 and the air guiding structures 12. In addition, small turbulent flows are generated when the air flows hit the air guiding structures 12, thereby increasing a wind force generated by the ceiling fan blades 100 during rotation.

Figure 4:
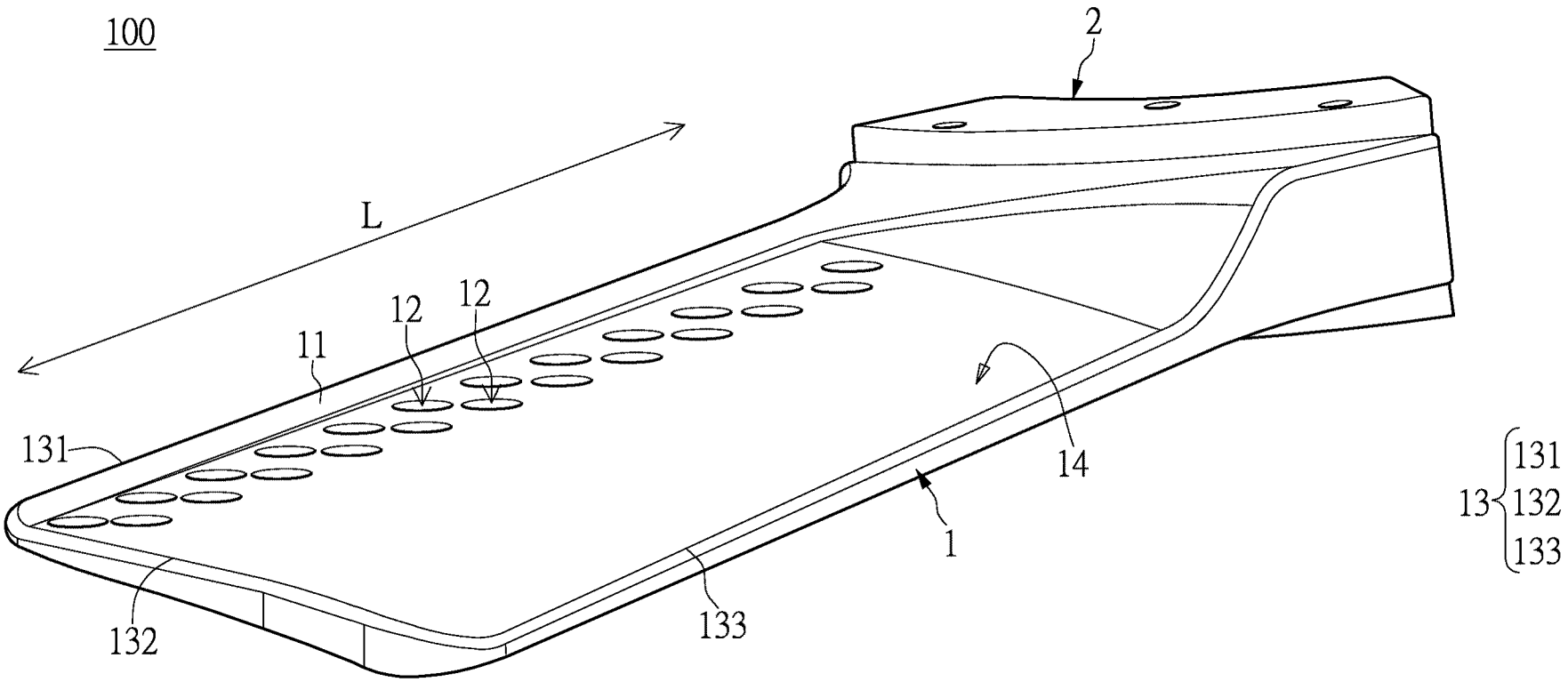
FIG. 4 is yet another perspective view of the ceiling fan blade according to the embodiment of the present disclosure.

As shown in FIG. 4, it should be noted that the air guiding structures 12 can be arranged in a plurality of rows, and the air guiding structures 12 are arranged in a direction parallel to the longitudinal direction L of the first side edge 131 of the windward portion 11 that is adjacent to the main body 1. The air guiding structures 12 are arranged in any two of the rows that are adjacent to each other, and are alternately formed on the main body 1. However, the present disclosure is not limited thereto.

For instance, in other embodiments of the present disclosure (not shown in the drawings), the air guiding structures 12 can be arranged in a direction not parallel to the longitudinal direction L of the first side edge 131 of the windward portion 11 that is adjacent to the main body 1. The air guiding structures 12 are arranged in any two of the rows that are adjacent to each other, but are not formed on the main body 1 in an alternate manner.

Figure 5:
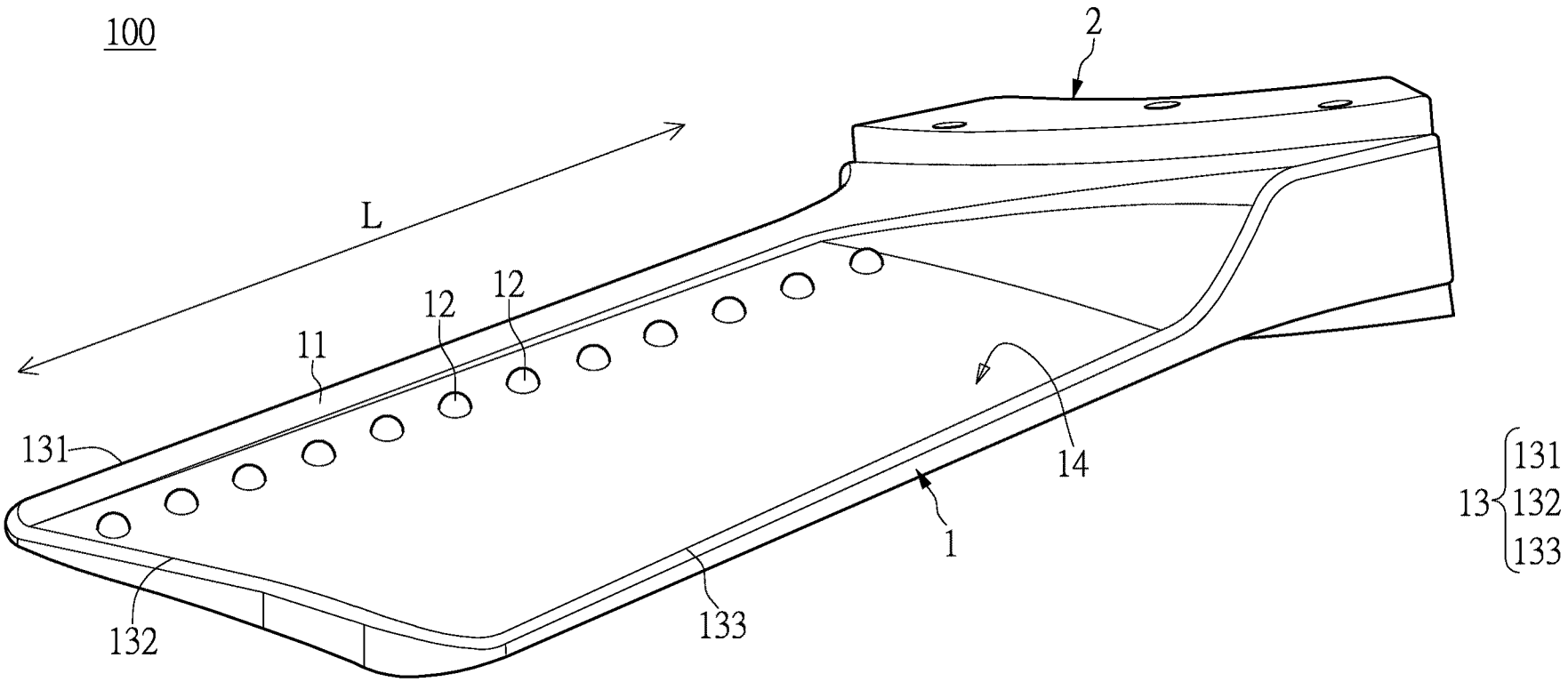
FIG. 5 is still another perspective view of the ceiling fan blade according to the embodiment of the present disclosure.

As shown in FIG. 1 and FIG. 2, it should be noted that each of the air guiding structures 12 is in a concave shape relative to an outer surface 14 of the main body 1, and a distance between any two adjacent ones of the air guiding structures 12 is the same. However, the present disclosure is not limited thereto. For instance, in other embodiments of the present disclosure (not shown in the drawings), the distance between any two adjacent ones of the air guiding structures 12 can be not the same. Further, as shown in FIG. 5, each of the air guiding structures 12 can be in a convex shape relative to the outer surface 14 of the main body 1.

Figure 6:
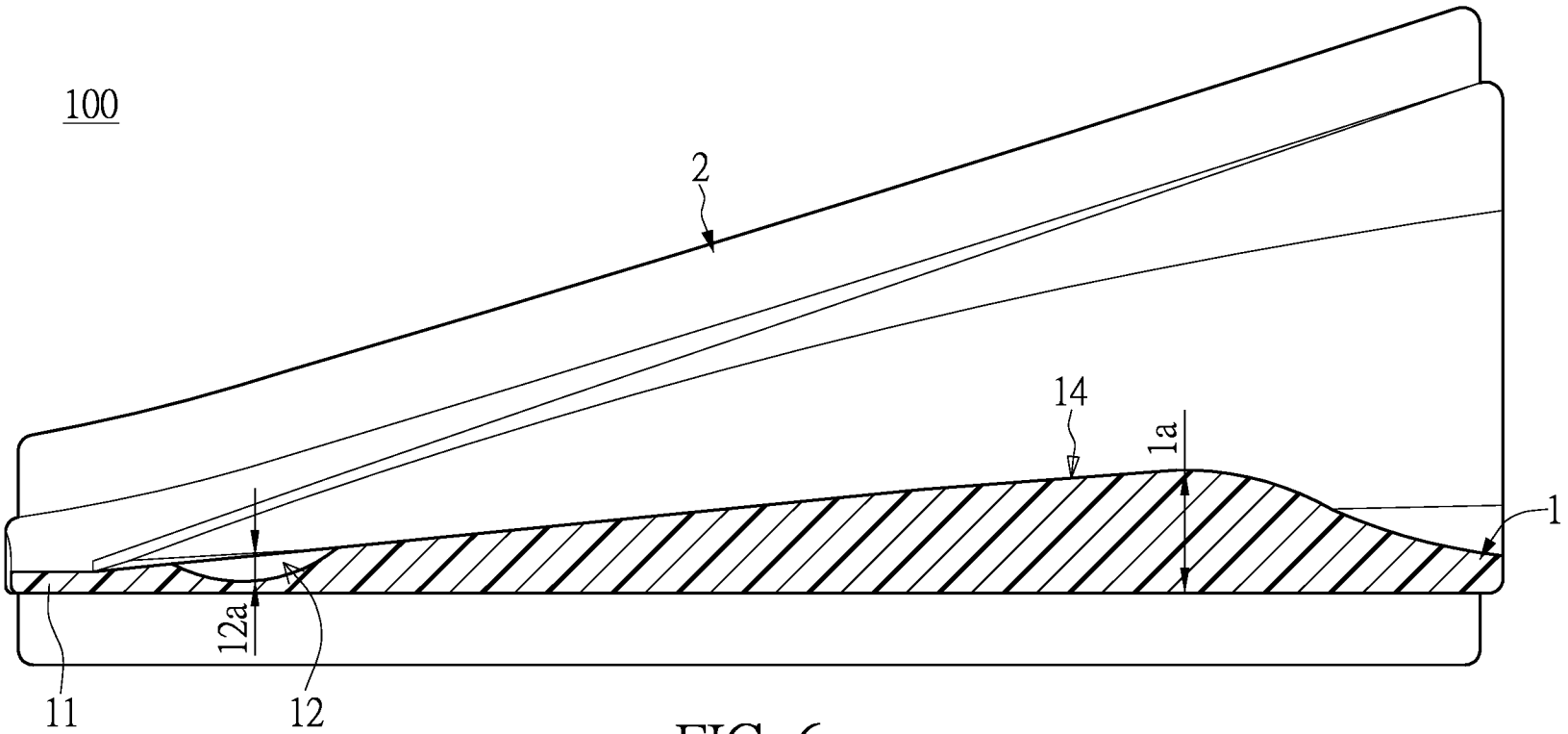
FIG. 6 is a cross-sectional view taken along line VI-VI of FIG. 2.

As shown in FIG. 6, it should be noted that when each of the air guiding structures 12 is in a concave shape relative to the outer surface 14 of the main body 1, each of the air guiding structures 12 has a depth 12*a* that is 0.1 to 0.3 times a thickness 1*a* of the main body 1. Accordingly, when the ceiling fan blades 100 are being rotated, small turbulent flows are generated when air flows hit the air guiding structures 12, thereby increasing a wind force generated by the ceiling fan blades 100 during rotation.

More specifically, as shown in a table below, the ceiling fan blades 100 in a control group do not have the air guiding structures 12, and the ceiling fan blades 100 in an experimental group have the air guiding structures 12. Each of the air guiding structures 12 in the experimental group has the depth 12*a* that is 0.5 mm.

The ceiling fan blades 100 in the control group and the ceiling fan blades 100 in the experimental group are rotated at a same speed to test the airflow during rotation. The simulated and measured airflow of the ceiling fan blades 100 of the experimental group is superior to the simulated and measured airflow of the ceiling fan blades 100 of the control group.

In other words, through the technical feature of "the ceiling fan blades 100 having the air guiding structures 12", wind power of the ceiling fan blades 100 of the experimental group can be effectively increased during rotation.

| Group | Depth 12a | Rotation speed | Simulated airflow | Measured airflow |
|---|---|---|---|---|
| Control group | 0 mm | 180 rpm | 5652 CFM | 6385 CFM |
| Experimental group | 0.5 mm | 180 rpm | 5995 CFM | 6529 CFM |

Beneficial Effects of the Embodiment

In conclusion, by virtue of "the distance defined between each of the air guiding structures 12 and the side of the main body 1 that is adjacent to the windward part being 0.2 to 0.4 times of the width of the main body 1", the ceiling fan blade 100 of the present disclosure can provide a smoother air flow, and an airflow generated thereby can be increased.

Furthermore, by virtue of "the distance defined between each of the air guiding structures 12 and the side of the main body 1 that is adjacent to the windward part being 0.25 to 0.35 times of the width of the main body 1", the ceiling fan blade 100 of the present disclosure can provide a smoother air flow, and an airflow generated thereby can be increased.

Furthermore, by virtue of "each of the air guiding structures 12 being in a concave shape relative to the outer surface 14 of the main body 1", when the ceiling fan blades 100 are being rotated, the air flows hit each of the air guiding structures 12 that is in a concave shape relative to the outer surface 14 of the main body 1, and small turbulent flows with different turbulent reflection angles are generated, thereby increasing a wind force generated by the ceiling fan blades 100 during rotation.

Furthermore, by virtue of "each of the air guiding structures 12 being in a convex shape relative to the outer surface 14 of the main body 1", when the ceiling fan blade 100 are rotated, small turbulent flows are generated when the air flows hit the air guiding structures 12. Furthermore, the air guiding structures 12 can be used for guiding the air flows that pass the outer surface 14 of the main body 1 to be closer to the outer surface 14. In this way, a rotation efficiency of the ceiling fan blades 100 can be increased.

Furthermore, by virtue of "the air guiding structures 12 being arranged in a row, and the air guiding structures 12 being arranged in the direction parallel to the longitudinal direction L of the first side edge 131 of the windward portion 11 being adjacent to the main body 1", when the air flows hit the air guiding structures 12, small turbulent flows parallel to each other can be generated. Accordingly, when the ceiling fan blades 100 are rotated, the outer surface 14 of the main body 1 can be used to generate a maximum amount of air flow.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A ceiling fan blade, which is configured to be mounted on a rotating base, the ceiling fan blade comprising:

a main body, including:

a windward part, including a first side edge, wherein each of a plurality of cross sections of the windward part are getting thicker along a windward direction;

a rear part, including a third side edge, wherein each of a plurality of cross sections of the rear part are getting thinner along the windward direction;

wherein a distance between the first side edge and a maximum thickness of the main body is greater than a distance between the third side edge and the maximum thickness of the main body; and a plurality of air guiding structures being recessed on top and in the windward part and arranged only in a single row arranged, wherein a distance defined between each of the air guiding structures and the first side edge of the main body is 0.2 to 0.4 times of a width of the main body; and a blade holder connected to the main body, wherein the blade holder is configured to be mounted on the rotating base;

wherein the single row is arranged in a direction parallel to a longitudinal direction of the first side edge of the main body.

2. The ceiling fan blade according to claim 1, wherein the distance defined between each of the air guiding structures and the side of the main body that is adjacent to the windward part is 0.25 to 0.35 times of the width of the main body.

3. The ceiling fan blade according to claim 1, wherein a distance between any two adjacent ones of the air guiding structures is the same.

4. The ceiling fan blade according to claim 1, wherein each of the air guiding structures is in a convex shape relative to an outer surface of the main body.

5. The ceiling fan blade according to claim 1, wherein each of the air guiding structures is in a concave shape relative to an outer surface of the main body.

6. The ceiling fan blade according to claim 5, wherein each of the air guiding structures has a depth that is 0.1 to 0.3 times a thickness of the main body.

* * * * *